US007178495B2

(12) United States Patent
Knecht et al.

(10) Patent No.: US 7,178,495 B2
(45) Date of Patent: Feb. 20, 2007

(54) ADJUSTING DEVICE FOR CAMSHAFTS, PARTICULARLY FOR MOTOR VEHICLES

(75) Inventors: Andreas Knecht, Kusterdingen (DE); Gerold Sluka, Nürtingen (DE); Edwin Palesch, Lenningen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 0 days.

(21) Appl. No.: 10/707,523

(22) Filed: Dec. 19, 2003

(65) Prior Publication Data

US 2005/0132991 A1 Jun. 23, 2005

(51) Int. Cl.
*F01L 1/34* (2006.01)

(52) U.S. Cl. ..... 123/90.17; 123/90.15; 123/90.31

(58) Field of Classification Search ..... 123/90.17, 123/90.31, 90.15
See application file for complete search history.

(56) References Cited

U.S. PATENT DOCUMENTS 5,960,757 A * 10/1999 Ushida ..... 123/90.17
6,085,708 A * 7/2000 Trzmiel et al. ..... 123/90.17
6,374,788 B1 4/2002 Fukuhara et al. ..... 123/90.17
6,439,182 B1 8/2002 Sugiura et al. ..... 123/90.17
6,460,496 B2 10/2002 Fukuhara et al. ..... 123/90.17
2003/0084863 A1* 5/2003 Golovatai-Schmidt et al. .. 123/90.17

FOREIGN PATENT DOCUMENTS

JP 2001041012 A * 2/2001

* cited by examiner

*Primary Examiner*—Thomas Denion
*Assistant Examiner*—Zelalem Eshete
(74) *Attorney, Agent, or Firm*—Gudrun E. Huckett

(57) ABSTRACT

An adjusting device for camshafts of motor vehicles has a stator having radial inwardly projecting stays and a rotor having vanes projecting into spaces defined between the stays of the stator. The rotor is rotatable relative to the stator and the vanes of the rotor are loadable on opposed sides with a pressure medium. The rotor is lockable relative to the stator in a locked position, wherein the stator has at least one locking bore and the rotor has a locking element having a locking position in which the locking element engages the locking bore and locks the rotor in the locked position. The locking element is moveable by the pressure medium from the locking position into a release position.

18 Claims, 8 Drawing Sheets

ADJUSTING DEVICE FOR CAMSHAFTS, PARTICULARLY FOR MOTOR VEHICLES

BACKGROUND OF INVENTION

1. Field of the Invention

The invention relates to an adjusting device for camshafts, in particular, camshafts of motor vehicles, comprising a stator having radially inwardly projecting stays. A rotor is arranged rotatably relative the stator. The vanes of the rotor project into the space between the stays. The vanes of the rotor can be loaded on opposed sides by a pressure medium.

2. Description of the Related Art

By means of the adjusting device, the camshaft is adjusted by rotation of the rotor relative to the stator. When the motor is turned off, the rotor remains in its current position relative to the stator. When starting the engine again, this can cause problems when the rotor has assumed an unfavorable rotational position relative to the stator.

SUMMARY OF INVENTION

It is an object of the present invention to configure the adjusting device of the aforementioned kind such that, in a constructively simple and reliable way, the rotor has an optimal position relative to the stator when the engine is started.

In accordance with the present invention, this is achieved in that the rotor can be locked in a locked position relative to the stator, wherein the stator has at least one locking bore that is engaged by a locking element of the rotor, wherein the locking element is moveable by the pressure medium into its release position.

In the adjusting device according to the invention, the rotor is locked by the locking element relative to the stator. In this connection, the locking element is moved by the pressure medium into its release position and is advantageously also secured in this release position. By a suitable adjustment of the supply of the pressure medium, it is achieved that the locking element engages the locking bore of the stator when the rotor has reached a predetermined position relative to the stator.

DETAILED DESCRIPTION

Figure 1:
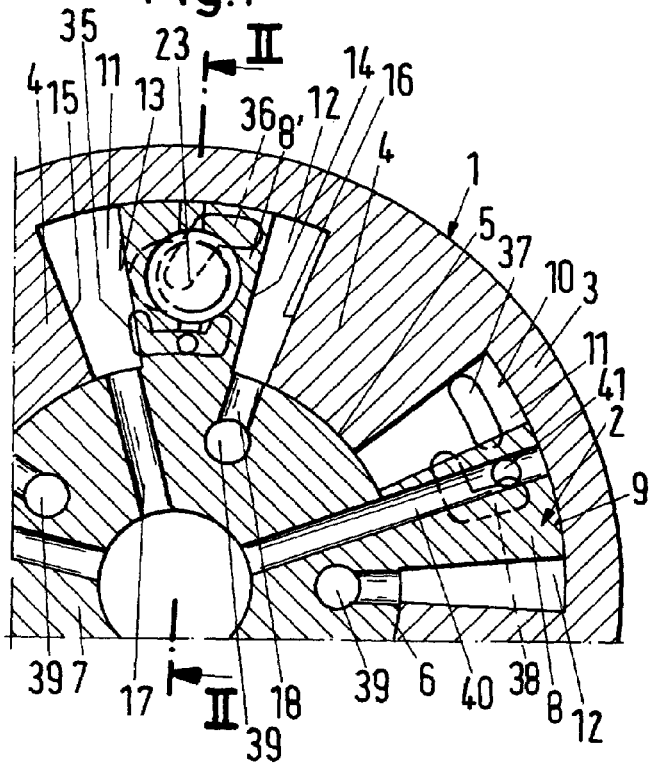
FIG. 1 is a radial section of a part of the adjusting device according to the invention.
Figure 2:
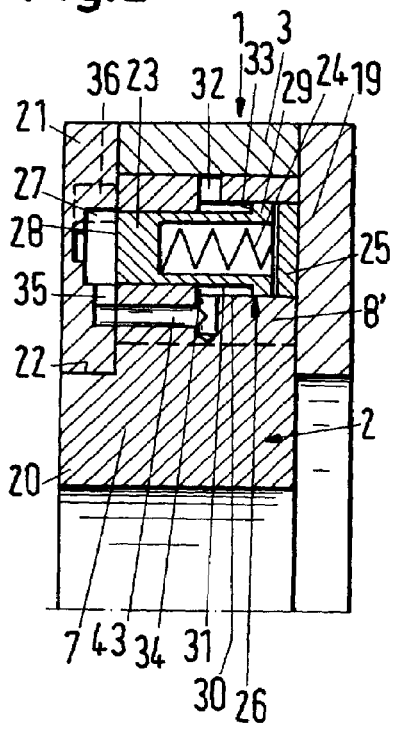
FIG. 2 is a section along the line II—II of FIG. 1.

The adjusting device is part of a camshaft adjusting device that is used in connection with motor vehicles. The basic configuration of such adjusting devices is known and is therefore not explained in detail.

The adjusting device has a stator 1 in which a rotor 2 is arranged to be rotatably to a limited extent. The configurations of the stator and of the rotor are known in general and are therefore only discussed briefly. The stator 1 has a cylindrical casing 3 and stays 4 projecting radially inwardly away from the casing 3. The stays 4 have the same angular spacing relative to one another.

The end faces 5 of the stays 4 rest a really against the cylindrical peripheral surface 6 of a base member 7 of the rotor 2. Vanes 8 project radially from the peripheral surface 6 of the base member 7 and rest with their curved free end faces 9 areally against the cylindrical inner wall 10 of the casing 3 of the stator 1. The vanes 8 widen in the direction toward the casing 3 of the stator 1; advantageously they widen continuously. However, it is also possible that the vanes 8 have a constant width across their length. Also, the width change of the vanes 8 can be non-continuous across their length. In any case, the width of the vanes 8 measured in the circumferential direction of the rotor is smaller than the spacing between the neighboring stays 4 of the stator 1. A rotor vane 8 projects into the space between two neighboring stays 4, respectively, and divides the area between neighboring stator stays 4 into two chambers 11 and 12. In both chambers 11, 12 a pressure medium is introduced so that the corresponding one of the opposed sides of the rotor vane 8 is loaded accordingly. In this way, the rotor 2 can be rotated relative to the stator 1 in the corresponding direction. The rotor 2 can be rotated maximally such that the vanes 8 with their lateral surfaces 13, 14 come to rest against the facing lateral surfaces 15, 16 of neighboring stator stays 4.

The pressure medium is introduced through bores 17, 18 in the base member 7 into the chambers 11 and 12, respectively. The bores 17, 18 are connected by an oil distributor (not illustrated) to a valve (not illustrated) that controls the supply of the pressure medium to the chambers 11 or 12.

The rotor base member 7 is fixedly connected to a camshaft (not illustrated) that is coupled in a way known in the art by an endless (continuous) drive to the crankshaft of the respective motor vehicle.

The stator 1 is closed at one side by an annular lid 19 that rests with its end face on the stator casing 3 and is preferably detachably connected thereto. The outer diameter of the annular lid 19 corresponds to the outer diameter of the stator casing 3. The rotor 2 rests with its vanes 8 areally on the inner side of the annular lid 19. The radial width of the annular lid 19 corresponds to the radial length of the vanes 8 so that the annular lid surrounds the camshaft at a spacing.

The base member 7 of the rotor 2 has at the side facing away from the annular lid 19 a central annular projection 20 surrounded by a locking disk 21. It rests also with its end face on the stator casing 3. The rotor vanes 8 are positioned so as to contact areally the inner side of the locking disk 21. In this way, the rotor 2 is axially secured in a reliable way by the annular lid 19 and the oppositely positioned annular locking disk 21. The locking disk 21 rests also against the cylindrical outer peripheral surface 22 of the projection 20 of the rotor base member 7. The end face of the projection 20 and the outer side of the locking disk 21 are positioned in a common plane.

One rotor vane 8' supports a locking bolt 23 with which the vane 8' and thus the entire rotor 2 can be locked in a center position relative to the stator 1 in a way to be described in the following. The locking bolt 23 is a hollow piston in which at least one pressure spring 24 is arranged which is supported with one end on the bottom plate 25 of an axial bore 26 in the rotor vane 8'. The bore 26 in the rotor vane 8' is closed relative to the annular lid 19 by the bottom plate 25 and is open in the direction toward the locking disk 21. The locking disk 21 has at its inner side a locking bore 27. The locking bolt 23 engages the locking bore 27 in the locking position under the force of the pressure spring 24.

The hollow piston 23 is closed relative to the locking disk 21. The piston surface 28 facing the locking disk 21 is planar and is loaded by a pressure medium when the locking bolt 23 is pushed back against the force of the pressure spring 24. Since the part of the locking bolt 23 provided with the piston surface 28 has a sufficient thickness, it can receive reliably the loads that occur in the locking position. The thickness of this bolt part is advantageously greater than the depth of the locking bore 27.

The locking bolt 23 is provided at its free end with a radially outwardly oriented flange 29 with which it rests against the inner wall 30 of a section 31 of the bore 26; the section 31 has a widened diameter relative to the rest of the bore 26. In the illustrated embodiment, this widened section 31 extends approximately across half the length of the bore 26. The locking bolt 23 rests against the inner wall of a section 32 of the bore 26; the section 32 has a reduced diameter relative to the rest of the bore 26.

The annular surface 33 of the flange 29 facing the locking disk 21 is loaded in a way to be described in the following with a pressure medium that flows into an annular chamber 34. The annular chamber 34 is delimited radially outwardly by the inner wall of the widened section 31 and radially inwardly by the locking bolt 23.

The annular chamber 34 is connected to a supply groove 35 via which the pressure medium is supplied. The supply groove 35 is provided in the locking disk 21 and communicates via an axial bore 43 in the vane 8' with the annular chamber 34. As illustrated in FIG. 1, the supply groove 35 is U-shaped. In the locking disk 21 a further supply groove 36 is provided via which the pressure medium can reach the piston surface 28 of the locking bolt 23. Both supply grooves 35, 36, depending on the position of the vane 8', are connected to the pressure chamber 11 or 12 of the stator 1. The supply groove 35 is U-shaped and the supply groove 36 is V-shaped.

The other pressure chambers of the stator 1 have two throttles in the form of throttle grooves 37 and 38, respectively. The throttle groove 37 is lunate or crescent-shaped and extends in the circumferential direction. The throttle groove 38 is approximately L-shaped. Moreover, a bore 39 opens into the chamber 12 through which pressure medium can be supplied to the chamber 12.

FIGS. 1 through 14 show the adjusting device in a position in which the motor of the motor vehicle is turned off. The rotor 2 has been rotated by means of a proportional solenoid valve (not illustrated) into a rest position in which the locking recess 27 is positioned to the left of the locking bolt 23. The rotor 2 is secured In this position until the engine is standing still. As soon as the engine has stopped, the proportional solenoid valve is switched to a currentless state. The proportional solenoid valve is switched such that the pressure line is connected to the working connector of the adjusting device. In this way, the pressure medium in the adjusting device is under pressure. Since the locking bolt 23 is not precisely aligned with the locking bore 27 of the locking disk 21, it cannot drop into its locking position.

Figure 3:
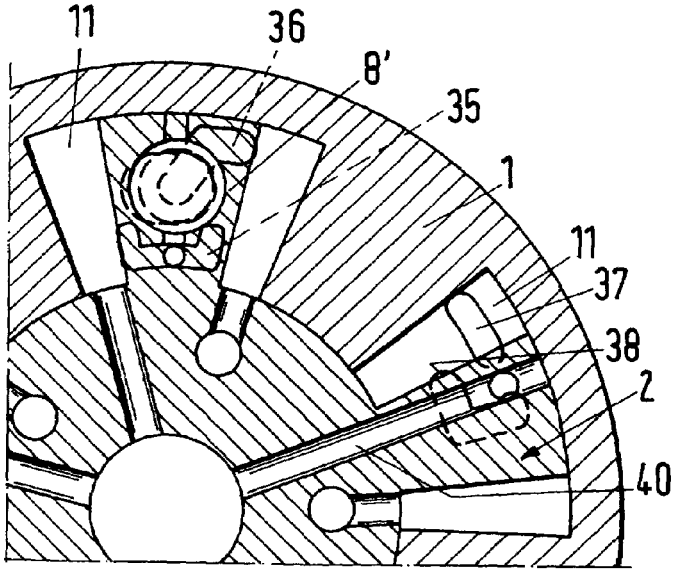
FIG. 3 shows in a view corresponding to that of FIG. 1 the adjusting device according to the invention in a first position.
Figure 4:
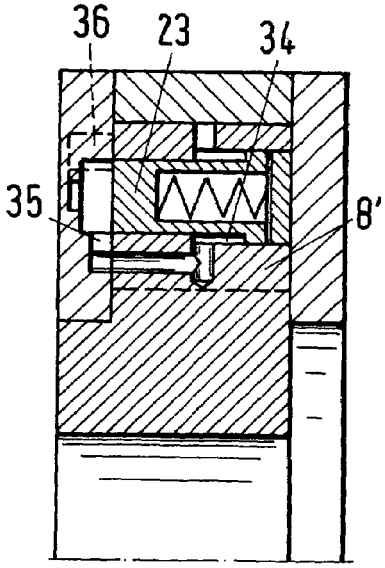
FIG. 4 is a view corresponding to that of FIG. 2 of the adjusting device in the position of FIG. 3.
Figure 5:
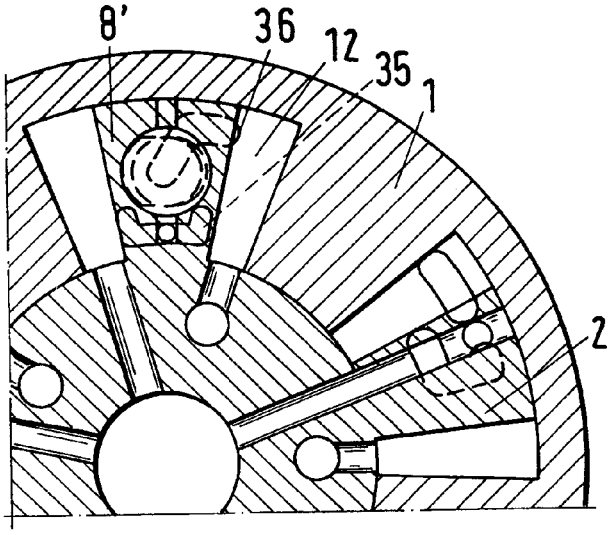
FIG. 5 shows in a view corresponding to that of FIG. 1 the adjusting device according to the invention in a second position.
Figure 6:
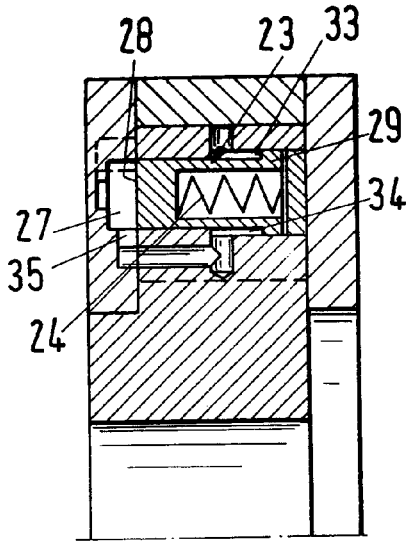
FIG. 6 is a view corresponding to that of FIG. 2 of the adjusting device in the position of FIG. 5.
Figure 7:
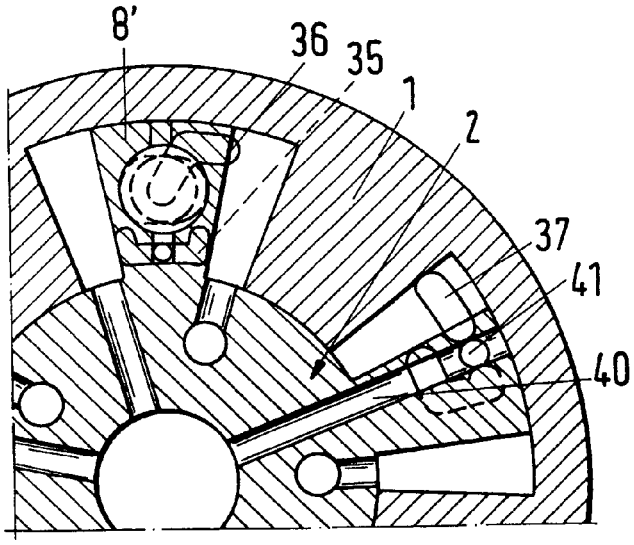
FIG. 7 shows in view corresponding to that of FIG. 1 the adjusting device according to the invention in a third position.
Figure 8:
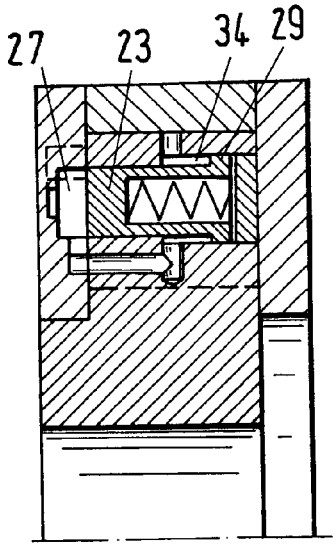
FIG. 8 is a view corresponding to that of FIG. 2 of the adjusting device in the position of FIG. 7.
Figure 9:
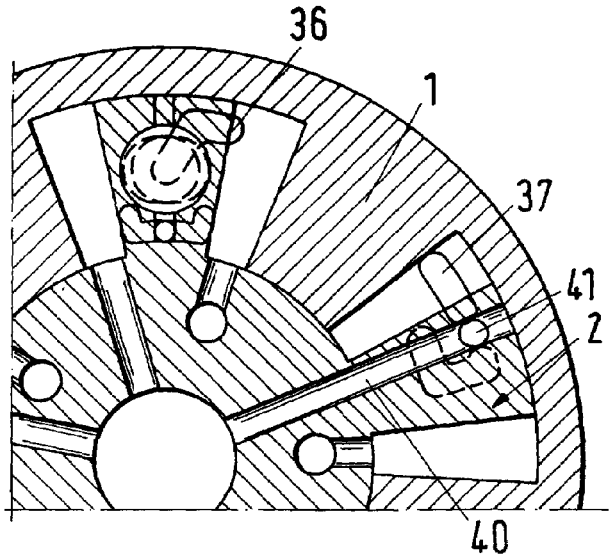
FIG. 9 shows in a view corresponding to that of FIG. 1 the adjusting device according to the invention in a fourth position.
Figure 10:
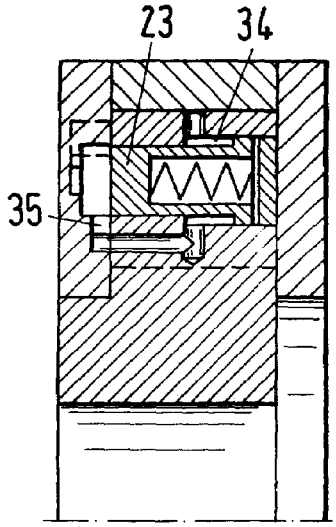
FIG. 10 is a view corresponding to that of FIG. 2 of the adjusting device in the position of FIG. 19.
Figure 11:
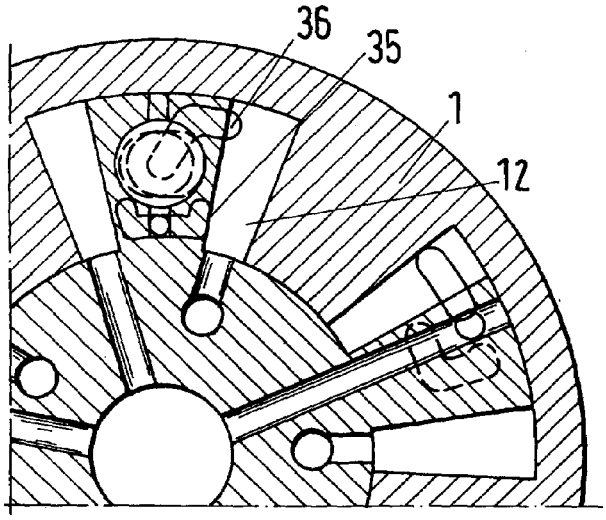
FIG. 11 shows in a view corresponding to that of FIG. 1 the adjusting device according to the invention in a fifth position.
Figure 12:
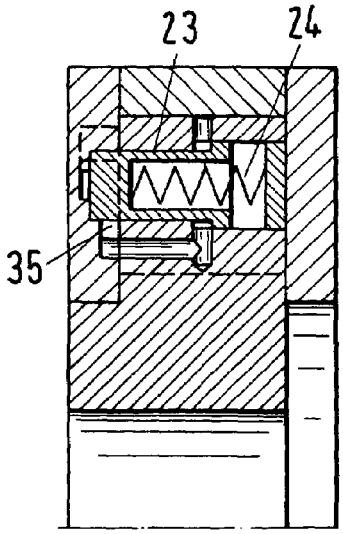
FIG. 12 is a view corresponding to that of FIG. 2 of the adjusting device in the position of FIG. 11.

When starting the motor, the rotor 2 rotates relative to the stator 1 in a counterclockwise direction. FIGS. 3 and 4 show the rotor 2 directly after starting the motor. In comparison to the position according to FIGS. 1 and 2, the rotor 2 has rotated about a fraction of a degree. The rotor vane 8' closes in the position according to FIG. 3 the supply grooves 35 and 36 completely. In the position according to FIG. 1, the rotor vane 8' closes off only the supply groove 36 while the groove 35 is only partially closed off. In this way, there is a connection between the chamber 11 and the supply groove 35. In the position according to FIGS. 3 and 4, the locking bolt 23 is not yet exactly aligned with the locking bore 27. In order to achieve this, the rotor 2 must be rotated relative to the stator 1 farther in the counterclockwise direction. In this way, the connection between the chamber 12 and the supply groove 36 is realized (FIGS. 5 and 6) so that the pressure medium upstream of the piston surface 28 of the locking bolt 23 can be routed via the supply groove 36 into the chamber 12. The farther the rotor 2 is rotated relative to the stator 1 in the counterclockwise direction, the father the supply groove 36 is released by the rotor vane 8'. The supply groove 35 on the other hand remains closed by the rotor vane 8' so that the pressure medium in the supply groove 35 cannot escape. In this way, the pressure medium in the annular chamber 34 also cannot escape. The annular surface 33 of the flange 29 of the locking bolt 23 is thus loaded so that the locking bolt can be retained counter to the force of the pressure spring 24 and cannot engage the locking recess 27.

FIGS. 5 to 8 show two positions of the rotor 2 after it has been rotated by a fraction of an angular degree relative to the stator 1 farther in the counterclockwise direction.

Figure 13:
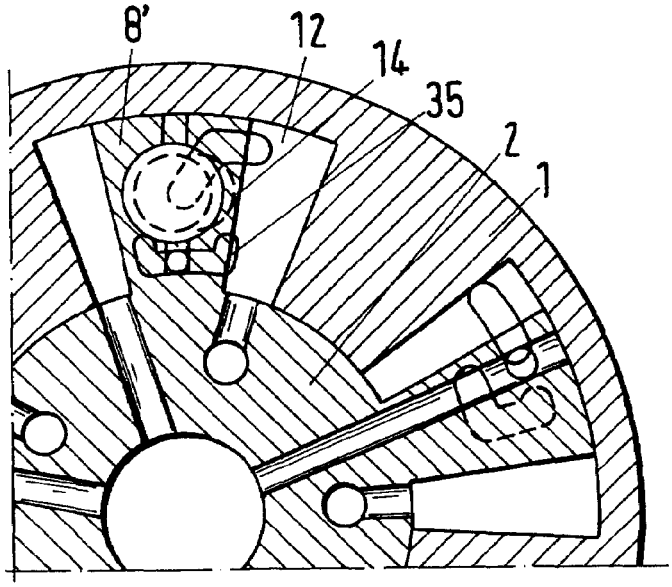
FIG. 13 shows in view corresponding to that of FIG. 1 the adjusting device according to the invention in a sixth position.
Figure 14:
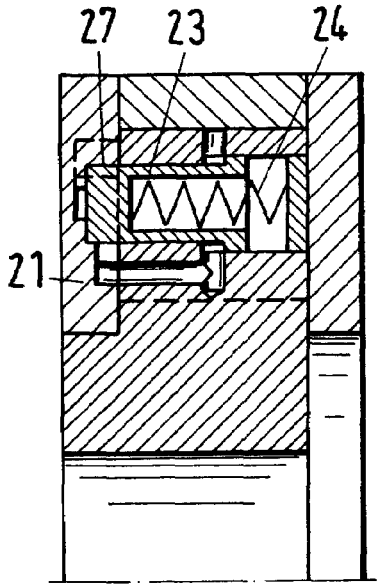
FIG. 14 is a view corresponding to that of FIG. 2 of the adjusting device in the position of FIG. 13.

Only when the rotor 2 has been rotated so far in the counterclockwise direction that the lateral surface 14 of the rotor vane 8' releases the supply groove 35, the pressure medium can escape from the annular chamber 34 via the supply groove 35 into the chamber 12 (FIGS. 13 and 14). The locking bolt 23 is then moved by the force of the pressure spring 24 into the locking bore 27 of the locking disk 21 (FIG. 14) so that the rotor 2 is locked in a central position relative to the stator 1. In order for the locking bolt 23 to be locked reliably, the locking bore 27 is slightly elongate in the rotational direction of the rotor 2.

During the described rotation of the rotor 2, the throttle grooves 37 in the chambers 11 are not covered by the rotor vanes 8. The throttle grooves 38, as illustrated in FIG. 1, are released to some degree by the rotor vanes 8 in the initial position of the rotor 2 when the motor is switched off so that these throttle grooves 38 communicate with the chambers 11. As soon as the rotor 2 has been rotated to such an extent that the supply groove 35 is completely covered by the rotor vane 8' (FIG. 5), the throttle grooves 38 are also completely covered by the remaining rotor vanes 8.

The throttle grooves 37, 38 prevent a movement of the locking bolt 23 that is too fast in the area of the locking bore 27. For the described movement of the rotor 2 in the counterclockwise direction, the pressure medium that is contained in the chambers 11 is supplied via the throttle grooves 37 to the throttle lines 40 that penetrate the rotor vanes 8 and the rotor base member 7 radially (FIG. 1). In the vicinity of the radial outer end, a transverse bore 41 branches off the throttle lines 40 in the axial direction, respectively. In the initial position of the rotor 1 according to FIG. 1, the transverse bores 41 are still positioned at a spacing relative to the throttle grooves 37. Only when the rotor vanes 8, 8' cover the supply groove 35 and the throttle grooves 38, the transverse bores 41 and the throttle grooves 37 will overlap, when viewed in the axial direction of the rotor, so that the pressure medium contained in the throttle grooves 37 can flow out via the transverse bores 41 and the throttle lines 40.

When the rotor 2 reaches the area of the locking position, the overflow cross-section of the chambers 11 and the throttle grooves 38 is reduced so that the rotor speed is reduced. In this way, it is ensured that the locking bolt 23 reliably engages the locking bore or recess 27.

Figure 15:
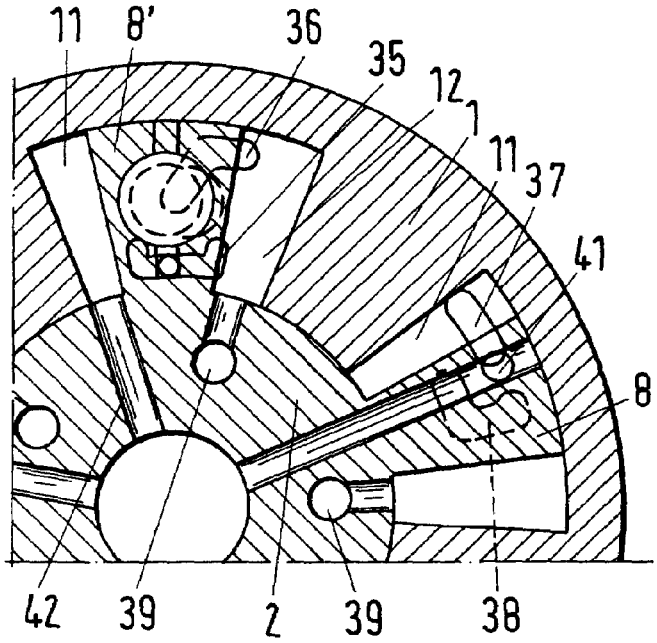
FIG. 15 shows in a view corresponding to that of FIG. 1 the adjusting device according to the invention in a seventh position.
Figure 16:
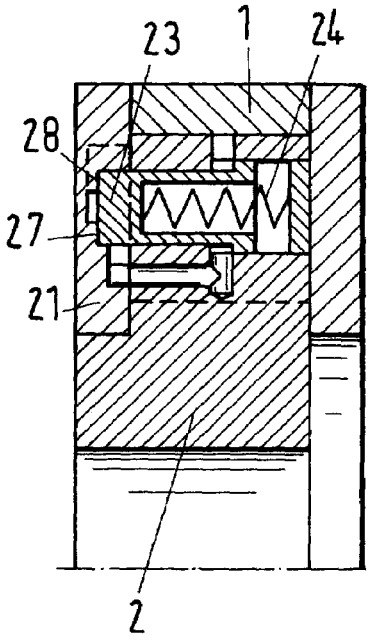
FIG. 16 is a view corresponding to that of FIG. 2 of the adjusting device in the position of FIG. 15.
Figure 19:
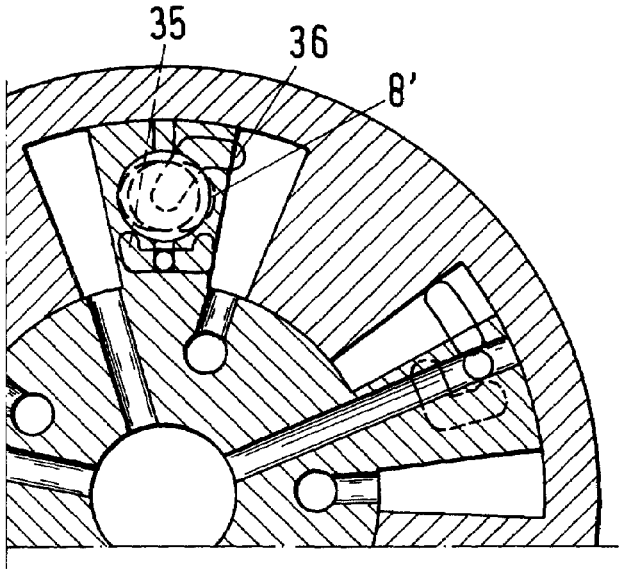
FIG. 19 shows in a view corresponding to that of FIG. 1 the adjusting device according to the invention in a ninth position.
Figure 20:
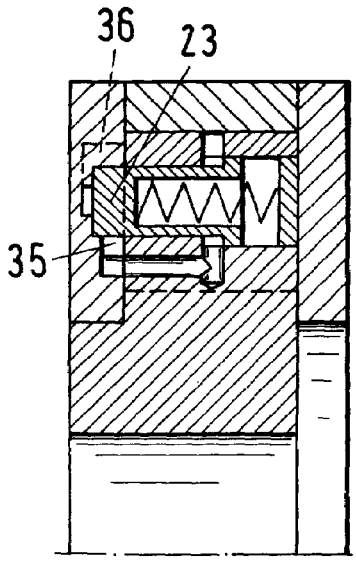
FIG. 20 is a view corresponding to that of FIG. 2 of the adjusting device in the position of FIG. 19.
Figure 17:
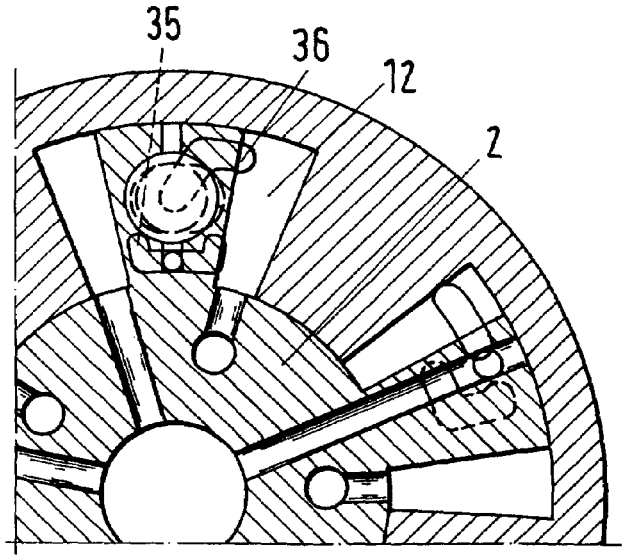
FIG. 17 shows in a view corresponding to that of FIG. 1 the adjusting device according to the invention in a eighth position.
Figure 18:
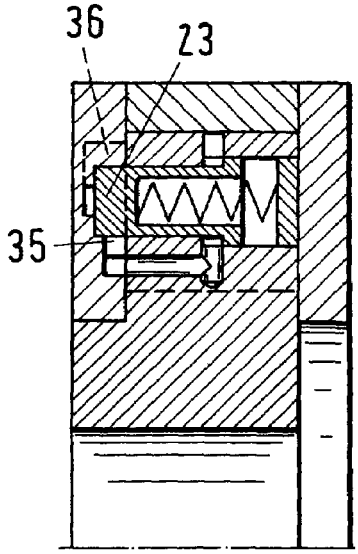
FIG. 18 is a view corresponding to that of FIG. 2 of the adjusting device in the position of FIG. 17.
Figure 23:
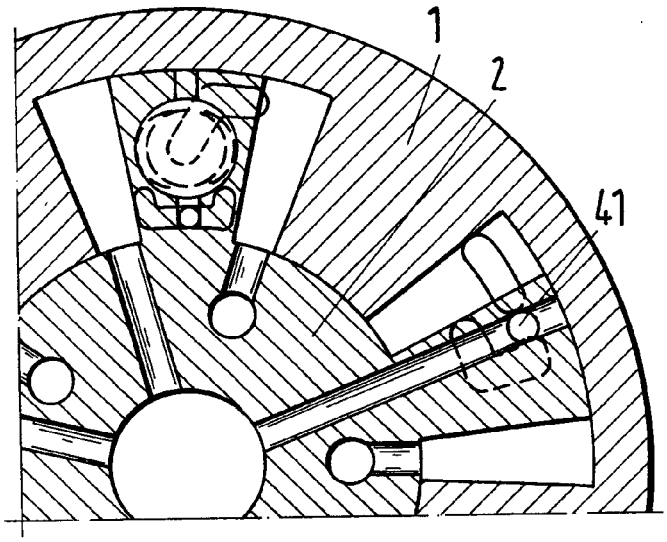
FIG. 23 shows in a view corresponding to that of FIG. 1 the adjusting device according to the invention in an eleventh position.
Figure 24:
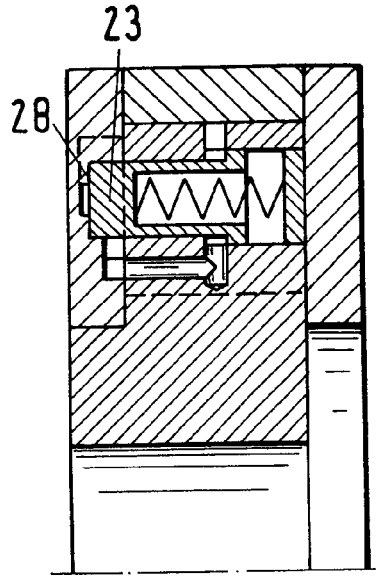
FIG. 24 is a view corresponding to that of FIG. 2 of the adjusting device in the position of FIG. 23.

FIG. 15 shows the rotor 2 in a locked position in which the locking bolt 23 engages the locking bore 27 of the locking disk 21 (FIG. 16). The two supply grooves 35, 36 are released partially by the rotor vane 8' so that a connection with the chamber 12 is provided. When in this locking position of the rotor 2 the engine of the motor vehicle is started, the proportional solenoid valve (not illustrated) is moved to a central position. In this way, both chambers 11, 12 on both sides of the rotor vanes 8, 8' are filled through the bores 39, 42 with the pressure medium. Through the supply groove 36 the medium under pressure flows into the area upstream of the piston surface 28 of the locking bolt 23. As long as the pressure of the spring 24 is greater than the pressure of the medium acting on the piston surface 28, the locking bolt 23 remains in its locking position. When the pressure of the pressure medium in the chamber 12 surpasses the force of the pressure spring 24, the locking bolt 23 is returned against the force of the pressure spring 24 into its release position (FIGS. 25 to 28). When the quantity conveyed into the chamber 12 increases relative to the quantity conveyed into the chamber 11, the rotor 2 is rotated relative to the stator 1 in the counterclockwise direction. When, on the other hand, the flow conveyed into the chamber 11 relative to the flow conveyed into the chamber 12 increases, the rotor 2 is rotated in the clockwise direction relative to the stator 2. This rotation of the rotor 2 relative to the stator 1 for a camshaft adjustment is known in the art and is therefore not explained in more detail. By means of different pressure loading of the chambers 11, 12, the rotor 2 can thus be rotated relative to the stator 1 in the desired direction for adjusting the camshaft.

In order for the locking bolt 23 to be secured in the retracted position, a very small rotation of the rotor 1 relative to the stator of, for example, only half an angular degree is sufficient in order to convey the pressure medium to the annular surface 33 (FIG. 26) of the flange 29 of the locking bolt 23. After the minimal rotation of the rotor 2, by means of the rotor vane 8' the supply groove 35 is opened (FIG. 25) so that the pressure medium of the respective chamber 11 or 12 can flow via the supply groove 35 in the inner side of the locking disk 21 and the axial bore 43 in the rotor vane 8' into the annular space 34. In this way, the annular surface 33 of the locking bolt 23 is loaded by the pressure medium such that it remains in its pushed-back position when the rotor 2 is rotated into the desired rotational position relative to the stator 1. The supply groove 35 is positioned symmetrically to the rotor vane 8' in the locked position of the rotor 1 (FIG. 11) and is covered by it in the locked position. As a result of the U-shaped configuration of the supply groove 35 and the corresponding width adjustment of the rotor vane 8', the minimal rotation of the rotor 2 in the clockwise direction or counter to the clockwise direction is sufficient in order to connect the supply groove 35 with the chamber 11 or the chamber 12. In this way, the pressure medium can reach the annular space 34 and can secure the locking bolt 23 in the described way in its retracted position against the force of the pressure spring 24.

Since the supply groove 36 in the locked position of the rotor 2 is in communication with the chamber 12 and supplies this chamber during start-up of the motor with the pressure medium, the piston surface 28 at the end face of the locking bolt 23 is loaded from the beginning with the pressure medium. The adjustment is selected such that first the force of the pressure spring 24 is greater than the pressure acting on the piston surface 28 exerted by the pressure medium. In this way, the locking bolt 23 remains in the locking position immediately after starting the motor. Only when sufficient pressure has been built up, the locking bolt 23 is returned against the force of the pressure spring 24 into the release position. Since after a very minimal rotation of the rotor 2—in the embodiment after approximately half an angular degree—the supply groove 35 is connected with the chamber 11 or 12, the annular surface 33 of the locking bolt 23 is practically loaded directly after return of the locking bolt with sufficient pressure in order to maintain the locking bolt in the retracted position.

FIGS. 15 to 28 show in individual steps how, within the very minimal rotational path of the rotor 2, the locking action is canceled by pushing back the locking bolt 23.

FIGS. 15 to 28 show also that by rotation of the rotor 2 the transverse bore 41 in the rotor vanes 8 cooperates with the throttle groove 37 or 38, depending on the rotational direction. In the illustrated embodiment, the rotor 2 is rotated in the clockwise direction relative to the stator 1 when starting the motor. As shown by means of the different positional illustrations according to FIGS. 15, 17, 19, 21, 23, 25, and 27, first the supply groove 35 is closed by the rotor vane 8' while the supply groove 36 is still in communication with the chamber 12. When the supply groove 35 is completely closed by the rotor vane 8', the pressure medium contained within the pressure chamber 34 cannot escape so that the locking bolt 23 is reliably secured in its position when it has been pushed back in the described way by pressure loading of its piston surface 28. Upon further rotation of the rotor 2 in the clockwise direction, finally also the supply groove 36 is closed by the rotor vane 8'. At the same time, the lateral surface 13 of the rotor vane 8' passes the control edge of the supply groove 35; the supply groove 35 is thus connected with the chamber 11 and the pressure medium contained therein (FIG. 27).

Figure 21:
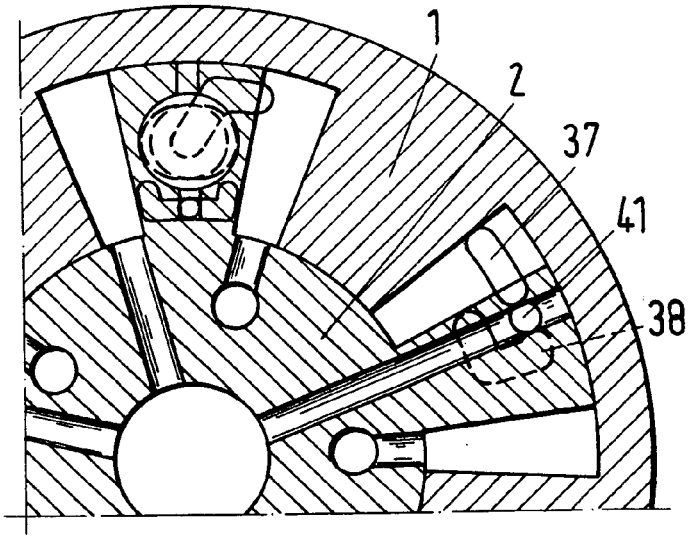
FIG. 21 shows in a view corresponding to that of FIG. 1 the adjusting device according to the invention in a tenth position.
Figure 22:
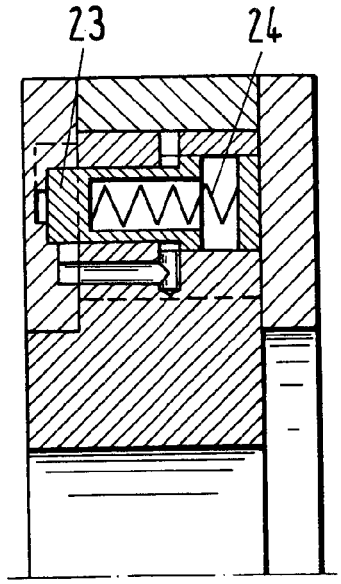
FIG. 22 is a view corresponding to that of FIG. 2 of the adjusting device in the position of FIG. 21.

Upon rotation of the rotor 2 in the clockwise direction out of the position according to FIG. 15, the transverse bores 41 of the remaining rotor vanes 8 are also moved correspondingly relative to the throttle grooves 37 and 38. Firstly, the transverse bores 41 are still in communication with the throttle grooves 37 in the chambers 11 (FIG. 15). A connection between the transverse bores 41 and the throttle grooves 38 is not provided in this position. When the rotor 2 is rotated farther in the clockwise direction, the transverse bores 41 are moved into a position between the two throttle grooves 37, 38 in which a connection between these throttle grooves and the transverse bores is not present (FIG. 21).

Finally, the transverse bores 41 overlap the throttle bores 38 (FIGS. 27 and 25) so that the pressure medium can flow via the throttle groove 38 into the chamber 11. In this way, the rotor speed will increase again.

Figure 27:
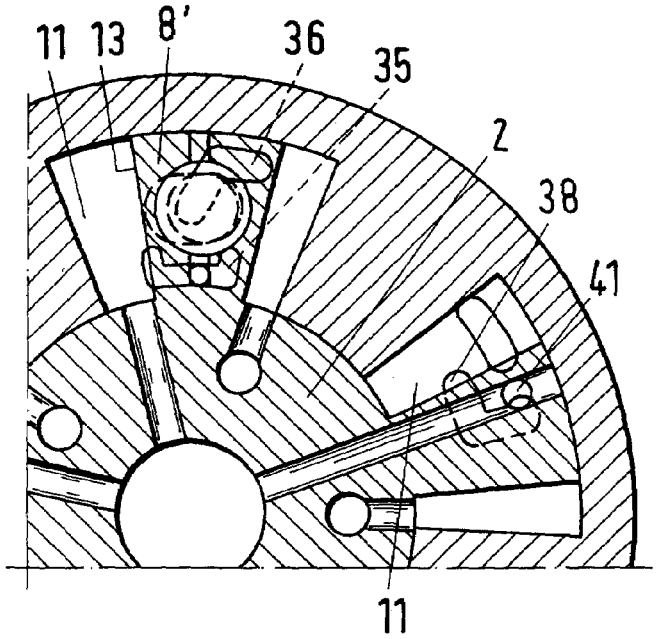
FIG. 27 shows in a view corresponding to that of FIG. 1 the adjusting device according to the invention in a thirteenth position.
Figure 28:
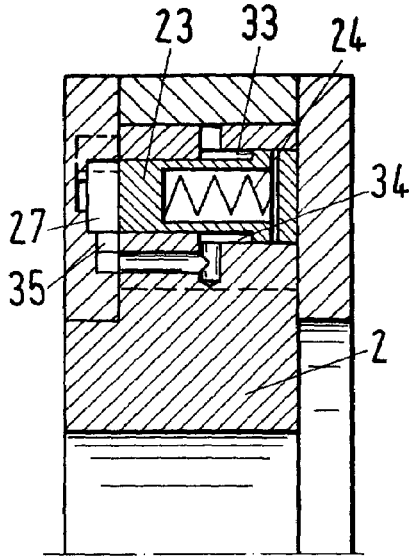
FIG. 28 is a view corresponding to that of FIG. 2 of the adjusting device in the position of FIG. 27.
Figure 25:
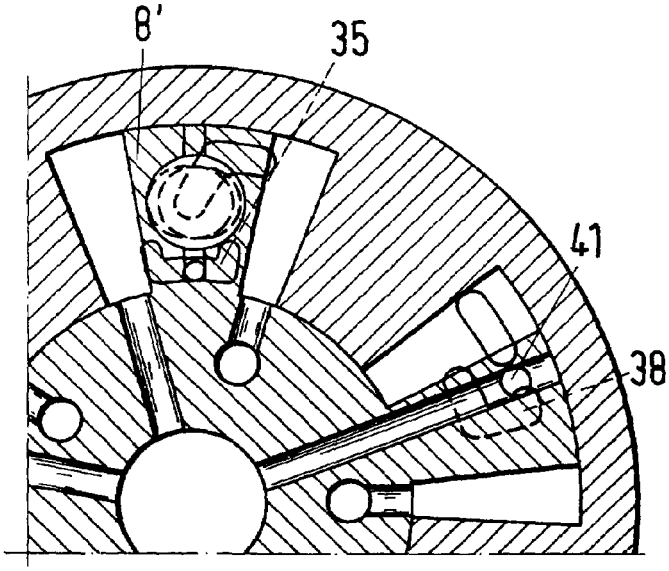
FIG. 25 shows in a view corresponding to that of FIG. 1 the adjusting device according to the invention in a twelfth position.
Figure 26:
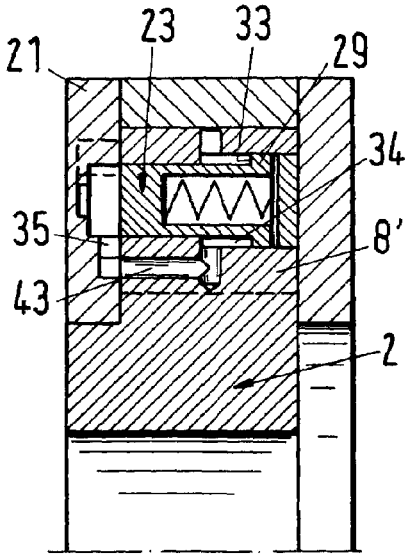
FIG. 26 is a view corresponding to that of FIG. 2 of the adjusting device in the position of FIG. 25.

When the rotor 2 is returned from the position according to FIG. 27 in the counterclockwise direction, the overflow cross-section between the throttle grooves 38 and the chambers 11 is reduced so that the rotor speed is also reduced. In this way, the rotor 2 reaches reliably the locking position in which the locking bolt 23 can drop into the locking bore 27.

While specific embodiments of the invention have been shown and described in detail to illustrate the inventive principles, it will be understood that the invention may be embodied otherwise without departing from such principles.

What is claimed is:

1. An adjusting device for camshafts of motor vehicles, comprising:

a stator having radial inwardly projecting stays;

a rotor having vanes projecting into spaces defined between the stays of the stator;

wherein the vanes separate the spaces into a first pressure chamber and into a second pressure chamber, respectively;

wherein the rotor is rotatable relative to the stator and wherein the vanes of the rotor are loadable on opposed sides with a pressure medium;

wherein the rotor is lockable relative to the stator in a locked position, wherein the stator has at least one locking bore and wherein the rotor has a locking element having a locking position in which the locking element engages the locking bore and locks the rotor in the locked position;

wherein the locking element is moveable from the locking position into a release position by the pressure medium supplied by a first supply groove and a second supply groove to independently load a first surface and a second surface of the at least one locking element, respectively;

wherein, when an engine of the motor vehicle is started with the locking element in the locking position, the second supply groove remains open and supplies the pressure medium to the second surface of the locking element, wherein the locking element remains in the locking position until a pressure of the pressure medium is greater than a counterforce force of the locking element forcing the locking element into the locking position, wherein the first supply groove alternatingly connects the first surface to the first pressure chamber or the second pressure chamber.

2. The adjusting device according to claim 1, further comprising a locking disk fastened on the stator, wherein the locking bore is provided in the locking disk.

3. The adjusting device according to claim 2, wherein the locking element has an end positioned in a bore of a first vane of the rotor, wherein the end of the locking element has an annular piston surface loadable by the pressure medium.

4. The adjusting device according to claim 1, wherein the locking bore is elongate iii a rotational direction of the rotor.

5. The adjusting device according to claim 1, further comprising at least one pressure spring generating the counterforce.

6. The adjusting device according to claim 1, wherein the locking element is a hollow piston.

7. The adjusting device according to claim 1, wherein the locking element is arranged to be slidable within a bore provided in a first one of the vanes of the rotor.

8. The adjusting device according to claim 1, wherein the locking element is arranged to be slidable within a bore provided in a first one of the vanes of the rotor, wherein at least one of the spaces, neighboring the space where the first vane of the rotor is arranged, has at least two throttles for reducing a rotational speed of the rotor shortly before the locking element engages the at least one locking bore.

9. The adjusting device according to claim 8, wherein the throttles are throttle grooves connecting a supply of the pressure medium with the at least one of the spaces.

10. An adjusting device for camshafts of motor vehicles, comprising:

a stator having radial inwardly projecting stays;

a rotor having vanes projecting into spaces defined between the stays of the stator;

wherein the rotor is rotatable relative to the stator and wherein the vanes of the rotor are loadable on opposed sides with a pressure medium;

wherein the rotor is lockable relative to the stator in a locked position, wherein the stator has a locking disk having at least one locking bore and wherein the rotor has a locking element having a locking position in which the locking element engages the locking bore and locks the rotor in the locked position;

wherein the locking element is moveable by the pressure medium from the locking position into a release position;

wherein the locking disk of the stator has first and second throttle grooves for reducing a speed of the rotor when approaching an area of the locking position of the locking bolt, wherein the first and second throttle grooves are arranged between stays of the stator so that the vanes of the rotor cover the first and second throttle grooves at least partially;

wherein the first and the second throttle grooves alternatingly communicate, depending on a rotational position of the rotor, with a throttle bore of the vanes of the rotor.

11. The adjusting device according to claim 10, wherein the locking element has an end face facing the locking bore and wherein the end face is loaded by the pressure medium.

12. The adjusting device according to claim 10, wherein the locking element is movable against a counterforce out of the locking position into the release position.

13. The adjusting device according to claim 3, wherein the end of the locking element has a radially outwardly oriented flange and wherein the annular piston surface is provided on the radially outwardly oriented flange.

14. An adjusting device for camshafts of motor vehicles, comprising:

a stator having radial inwardly projecting stays;

a rotor having vanes projecting into spaces defined between the stays of the stator and dividing the spaces into pressure chambers;

wherein the rotor is rotatable relative to the stator and wherein the vanes of the rotor are loadable on opposed sides with a pressure medium;

wherein the rotor is lockable relative to the stator in a locked position, wherein the stator has at least one locking bore and wherein the rotor has a locking element having a locking position in which the locking element engages the locking bore and locks the rotor in the locked position;

wherein the locking element is moveable from the locking position into a release position by the pressure medium supplied by a first supply groove and a second supply groove to independently load a first surface and a second surface of the at least one locking element respectively;

wherein, when an engine of the motor vehicle is started with the locking element in the locking position, the second supply groove remains open and supplies the pressure medium to the second surface of the locking element wherein the locking element remains in the locking position until a pressure of the pressure medium is greater than a counterforce force of the locking element forcing the locking element into the locking position;

wherein the locking element has an end positioned in a bore of a first vane of the rotor and provided with an annular piston surface loadable by the pressure medium;

wherein the vanes separate the spaces into a first pressure chamber and into a second pressure chamber, respectively, wherein the annular piston surface delimits axially an annular chamber, wherein the annular chamber is connected alternatingly by the first supply groove to the first pressure chamber or the second pressure chamber.

15. The adjusting device according to claim 14, wherein the first supply groove is closed by the first vane of the rotor in the release position of the locking element.

16. The adjusting device according to claim 14, wherein the first supply groove is provided in a locking disk fastened to the stator.

17. The adjusting device according to claim 14, wherein the second supply groove opens into the at least one locking bore and connects the at least one locking bore with the first pressure chamber or the second pressure chamber of the stator.

18. The adjusting device according to claim 17, wherein the second supply groove is closable by the first vane of the rotor in the release position of the locking element.

* * * * *